US010199144B2

(12) United States Patent
Stadler et al.

(10) Patent No.: US 10,199,144 B2
(45) Date of Patent: Feb. 5, 2019

(54) DATA CABLE AND STRANDED CONDUCTOR

(71) Applicant: LEONI KABEL GMBH, Nuremberg (DE)

(72) Inventors: Wolfgang Stadler, Hilpoltstein (DE); Markus Schill, Munich (DE); Johannes Nachtrab, Windsbach (DE); Rainer Poehmerer, Winkelhaid (DE); Yuecel Sahiner, Nuremberg (DE); Erwin Koeppendoerfer, Schwabach (DE); Dominik Dorner, Pleinfeld (DE)

(73) Assignee: LEONI Kabel GmbH, Nuremberg (DE)

( * ) Notice: Subject to any disclaimer, the term of this patent is extended or adjusted under 35 U.S.C. 154(b) by 0 days.

(21) Appl. No.: 15/439,212

(22) Filed: Feb. 22, 2017

(65) Prior Publication Data

US 2017/0243678 A1 Aug. 24, 2017

(30) Foreign Application Priority Data

Feb. 23, 2016 (DE) ..... 10 2016 202 791

(51) Int. Cl.
*H01B 7/00* (2006.01)
*H01B 11/12* (2006.01)
(Continued)

(52) U.S. Cl.
CPC ..... *H01B 11/12* (2013.01); *H01B 7/0009* (2013.01); *H01B 11/002* (2013.01); *H01B 7/30* (2013.01); *H01B 11/00* (2013.01)

(58) Field of Classification Search
CPC ..... H01B 11/12; H01B 7/009; H01B 11/02; H01B 7/30
(Continued)

(56) References Cited

U.S. PATENT DOCUMENTS 2,197,544 A * 4/1940 Atkinson ..... H01B 7/30 174/128.1
3,586,751 A * 6/1971 Schoerner ..... B22D 11/0602 174/113 R
(Continued)

FOREIGN PATENT DOCUMENTS

CN 203013375 U * 6/2013 ..... H01B 9/00
DE 961722 C 4/1957
(Continued)

OTHER PUBLICATIONS

Schymura M.A., Fischer A: Beitrag zur Untersuchung der Ermüdungseigenschaften dünner Drähte aus Kupferbasiswerkstoffen unter Biegewechselbeanspruchung nach ASTM B470 [Contribution to the Examination of Fatigue Properties of Thin Wires made of Copper-Based Materials under Alternating Bending Loading]—02. Metall, 66, 11 (2012), pp. 514-517, ISSN 0026 0746.

*Primary Examiner* — William H Mayo, III
(74) *Attorney, Agent, or Firm* — Laurence A. Greenberg; Werner H. Stemer; Ralph E. Locher

(57) ABSTRACT

A data cable has a specially formed stranded conductor, as a result of which the transmission properties of the data cable are significantly improved. The stranded conductor is surrounded by insulation and has an unpressed assembly composed of a plurality of individual wires which are of a same type and being embodied as external wires and being disposed around a center. The external wires are embodied with a non-round cross section, with a result that when viewed in cross section an extent of the external wires increases radially outward from the center.

14 Claims, 4 Drawing Sheets

(51) Int. Cl.
*H01B 11/00* (2006.01)
*H01B 7/30* (2006.01)

(58) Field of Classification Search
USPC ..... 174/102 R, 103, 105, 106 R, 108, 109, 174/128.1, 128.2
See application file for complete search history.

(56) References Cited

U.S. PATENT DOCUMENTS 4,687,884 A * 8/1987 DeHart ..... H01B 5/002 174/128.1
5,496,969 A * 3/1996 Blackmore ..... H01B 5/08 174/113 A
6,307,156 B1 * 10/2001 Avellanet ..... B21C 37/045 174/128.1
7,197,809 B2 * 4/2007 Gai ..... D07B 1/0693 29/508
2005/0205287 A1 * 9/2005 Browning ..... H01B 9/008 174/102 R
2005/0279527 A1 * 12/2005 Johnson ..... H01B 13/0235 174/106 R
2007/0193767 A1 * 8/2007 Guery ..... H01B 5/105 174/106 R
2009/0308637 A1 * 12/2009 Amils ..... H01B 5/104 174/130
2012/0261158 A1 * 10/2012 Daniel ..... B29C 70/523 174/102 A
2012/0267141 A1 * 10/2012 Kamiyama ..... B21C 37/047 174/102 R
2013/0264093 A1 * 10/2013 Fontana ..... H01B 3/445 174/113 R
2014/0041925 A1 * 2/2014 Davis ..... H01B 7/29 174/40 R
2016/0247602 A1 8/2016 Schill et al.

FOREIGN PATENT DOCUMENTS

DE 102012014944 A1 1/2014
JP S5561913 U 4/1980
JP S5883708 S 6/1983
JP H07153327 A 6/1995
JP 2014096349 A 5/2014
JP WO2015/067717 A * 11/2014 ..... H01B 7/04
WO 2015067717 A1 5/2015

* cited by examiner

DATA CABLE AND STRANDED CONDUCTOR

CROSS-REFERENCE TO RELATED APPLICATION

This application claims the priority, under 35 U.S.C. § 119, of German application DE 10 2016 202 791.3, filed Feb. 23, 2016; the prior application is herewith incorporated by reference in its entirety.

BACKGROUND OF THE INVENTION

Field of the Invention

The invention relates to a data cable and to a stranded conductor.

International patent disclosure WO 2015/067717 A1 describes, for example, a stranded conductor which has a plurality of specially shaped external wires which are grouped around a central internal wire. The external wires have a triangular cross-sectional shape with rounded corners, which results in a particularly compact conductor.

A data cable serves primarily for the transmission of signals, which frequently occurs at high frequencies, e.g. in the GHz range. In the case of a conductor which is used for the data cable, the conduction of current then occurs mainly at the external circumference of the conductor owing to the skin effect. In the case of a stranded conductor there is then the problem that owing to the plurality of combined individual wires the external circumference is not circular and as a result there are inevitably variances and interference points which have an overall adverse effect on the transmission properties during the transmission of signals, and specifically give rise to high signal damping.

SUMMARY OF THE INVENTION

Against this background, an object of the invention is to specify a data cable with improved transmission properties. Furthermore, a stranded conductor which is suitable for this is to be specified.

The object is achieved according to the invention by a data cable having the features of the main data cable claim and by a stranded conductor having the features of the main stranded conductor claim. Advantageous refinements, developments and variants are the subject matter of the dependent claims. The statements here relating to the data cable also apply correspondingly to the stranded conductor.

The data cable serves primarily for the transmission of signals, i.e. data, for example at high frequencies in the range between several 100 kHz, in particular 1 MHz, and 100 GHz. The data cable has a stranded conductor which has an unpressed assembly composed of a plurality of individual wires. These individual wires are of the same type and are embodied as external wires and are arranged around a center. In this context, the external wires are embodied with a non-round cross section, i.e. with a non-round cross-sectional shape, with the result that when viewed in cross section the extent of the external wires increases radially outward from the center. The individual wires which are intended as external wires for a corresponding stranded conductor are prefabricated, in particular, with a non-round cross section and are arranged as such around the center, i.e. the external wires are already stranded with a non-round cross section.

The use of the specially shaped stranded conductors significantly improves the transmission properties of the data cable. It is essential here to approximate the external circumference of the stranded conductor to a circular shape. The external wires are each specially shaped segments which when combined form an annular assembly to a good approximation. As a result of the non-round configuration, a respective external wire advantageously has, together with a virtual circle around the common stranded conductor, a plurality of contact points and not merely one, as in the case of round individual wires of a conventional stranded conductor. The interstices formed between the individual wires on the external circumference are significantly smaller, with the result that a particularly small degree of variance in diameter occurs in the circulating direction around the stranded conductor. The effect of the interstices as interference points during the transmission of signals is correspondingly reduced.

A further advantage is that, in particular, during the transmission of signals the distribution of current in the specially shaped stranded conductor is more homogenous. Generally, the current density increases from the inside to the outside and reaches a maximum at the outermost points of the stranded conductor. As a result of the approximation to a circular shape, the current density in the external region along the external circumference is distributed significantly better, and therefore is more homogenous, as a result of which ultimately lower signal damping is achieved.

It is also particularly advantageous that the path from the radially outermost point of an external conductor to the point of contact with an adjacent external conductor is reduced. This is significant, in particular, in the case of high-frequency lines since here current does not necessarily flow only in the individual wires but rather can also flow between the individual wires. Along the distance which is to be covered by the current here there is a loss which is advantageously reduced by the specific shape of the external conductors. A further loss arises at the point of contact between two external wires. This loss is dependent on the contact area between the external wires, and is correspondingly large in the case of individual wires. In contrast, the contact area is increased here and the loss is correspondingly reduced. Overall, accordingly in the present data cable the losses which usually arise particularly for high-frequency signals are significantly reduced.

The specific shape and arrangement of the external wires also has advantages in terms of the voltage distribution in the stranded conductor. As a result of the generally rounder configuration both of the single individual wires and of the entire assembly of the individual wires, the voltage distribution is more homogenous overall. The risk of partial discharge is significantly reduced, i.e. the data cable has an improved partial discharge strength. In the case of conventional stranded conductors, an additional conductive internal layer is also sometimes arranged within the assembly for the purpose of field control. It is possible to dispense with such an internal layer here, and one is advantageously also dispensed with.

The assembly composed of individual wires is unpressed in the prefabricated stranded conductor, that is it is not shaped only subsequently by pressing or by compacting from original round individual wires into the non-round geometry. The non-round cross section of the external wires is selected here such that the given space or location is utilized as completely as possible, and that the cross section of the assembly is as far as possible circular at least in the circumferential region, i.e. along the circumferential contour. As a result, the interstices which remain on the circumferential side are at least significantly reduced compared to round individual wires.

Since the assembly is not pressed and therefore is not subjected to any subsequent compacting and therefore no cold shaping, during the manufacture of the stranded conductor an annealing process for the assembly, customary in the case of compacting, can be and is dispensed with, making the fabrication of corresponding stranded conductors less costly. In addition, such an unpressed assembly composed of individual wires has a high resistance to alternating bending, which is advantageous for a multiplicity of applications. High resistance to alternating bending or alternating bending resistance is understood here to mean that the stranded conductor withstands a relatively large number of alternating bending processes, that is to say small fatigue phenomena during alternating bending loading. For a more wide ranging explanation of the terms, reference is made here to ASTM B470 and to the publication entitled "Schymura M. A., Fischer A.: Beitrag zur Untersuchung der Ermüdungseigenschaften dünner Drähte aus Kupferbasiswerkstoffen unter Biegewechselbeanspruchung nach ASTM B470 [Contribution to the Examination of Fatigue Properties of Thin Wires made of Copper-Based Materials under Alternating Bending Loading]—02. Metall, 66, 11 (2012), pp. 514-517, ISSN 0026 0746".

This high alternating bending resistance is reached, in contrast with a compacted stranded conductor, simply by dispensing with the compacting step and the simultaneous use of non-round individual wires in the initial state before the stranding. In contrast to compacted stranding conductors, the individual wires in fact bear comparatively loosely one against the other, with the result that they can move relative to one another with relatively low friction. In contrast to this, the individual wires in the case of the compacted stranded conductor are deformed by the compacting in such a way that they are pressed one against the other over a surface and as a result are, as it were, interlocked with one another at their surfaces. At the same time, the advantage of compacted stranded conductors is maintained, specifically of maintaining the most round possible circumferential contour.

Such a stranded conductor is used, in particular, as a super-thin line, in particular vehicle line.

In one preferred refinement, the data conductor is surrounded by a shield. In one variant, the shield merely surrounds the data conductor or alternatively also a plurality thereof or all of the data conductors jointly. The shield is embodied, for example, as a foil, tape or braid. Owing to the particularly round shape of the stranded conductor, a particularly uniform distance also occurs between the stranded conductor and the shield in the circumferential direction, as a result of which the transmission properties of the data cable are further improved overall.

In one suitable development, the data conductor is surrounded concentrically by the shield and forms a coaxial cable therewith. The distance between the stranded conductor i.e. a circumferential contour of the stranded contour, and the shield is particularly homogenous in the circumferential direction.

As an alternative to the embodiment as a coaxial cable, the data conductor forms a wire and preferably a plurality of wires are combined to form an assembly. In particular, a plurality of wires form a twisted assembly. According to a first variant, two wires form a wire pair, which is preferably surrounded by a pair shield. The wire pair is preferably twisted and forms what is referred to as a "twisted pair", which then does not necessarily have to be surrounded by a pair shield. Alternatively, the wires of the pair are guided in parallel and form an "untwisted pair".

Even in the case of a wire pair, the particularly round circumferential contour of the stranded conductors is also advantageous, since as a result the distance between the two stranded conductors of the wire pair is also particularly uniform. Particularly in the case of wires which are twisted with one another and which run around one another, a particularly uniform distance comes about between the two wires owing to the particularly round circumferential contour along the entire length of the wire pair.

As an alternative to the paired arrangement, the wires can also be arranged in a four-stranded assembly, for example in what is referred to as a star quad.

The insulation is either applied individually to the stranded conductors in each case or is embodied as common insulation. The insulation is composed, for example, of a plastic and is applied by extrusion.

It is basically conceivable to arrange the external wires jointly about a central conductor, referred to below as a central conductor, which is arranged in the center and is, in particular, also embodied as an individual wire, i.e. then as an internal wire. In such a suitable variant, the central conductor is then preferably circular. The individual wires are preferably adapted to the respective application purpose. In the case of a two-layer stranded conductor with a central conductor and an external layer composed of external wires, the latter is preferably composed of the one central conductor and a plurality of external wires, in particular six. In the case of stranded conductors with a plurality of external layers, at least the outermost layer is formed from the external wires with the non-round cross section. In this case, the external wires surround the center indirectly with intermediate arrangement of one or more intermediate layers of individual wires which are embodied in a round fashion or preferably in a non-round fashion like the outermost external wires.

However, in one particularly preferred variant, the stranded conductor is free of a central conductor, i.e. there is no conductor arranged in the center. This is initially based on the idea that the specific shape and arrangement of the external wires also has advantages from a structural point of view. In cross section, the external wires in fact each form segments which are supported on one another in the manner of an arch, with the result that a carrying element or supporting element is not required in the center, and such an element is expediently dispensed with. Particularly in combination with twisting of the external wires with one another, forces which act on the assembly are deflected in the longitudinal direction of the stranded conductor. In contrast to customary strand conductors, the internal wire is then dispensed with and in this way saving in material is achieved. Furthermore, a reduction in weight is achieved, in particular in the range from approximately 3 to 8% compared to conventional stranded conductors. Even in the case of a stranded conductor with a plurality of layers of external wires, an empty center, i.e. omission of the internal wire, is advantageous.

The variant without an internal wire, in particular with a cavity or empty space in the center, is advantageous particularly in terms of preparation of the data cable. In the case of crimping, the stranded conductor is squeezed at an end side in a crimp. In a customary B-shaped crimp with two arms, these are pressed into the stranded conductor and form two chambers between which the individual wires are distributed. In a customary stranded conductor with a 6+1 geometry, i.e. with an internal wire, unequal distribution inevitably occurs, whereas when an internal wire is absent, six external wires are distributed uniformly, advantageously resulting in more homogenous mechanical loading. This refinement with the cavity in the center can basically also be used for stranded conductors which are not used for data conductors.

In one advantageous alternative, in the center of the stranded conductor a functional element is arranged, in particular instead of an internal wire. The center is as a result assigned an alternative use in an advantageous and space-saving manner. The functional element is then, in particular, guided centrally and surrounded uniformly by the external wires. In this variant, the external wires advantageously form a mechanical protection for the internal functional element.

In one suitable development, the functional element is embodied as a strain relief element. As a result, the stranded conductor is particularly robust with respect to tensile loading along the longitudinal direction. The functional element is here, for example, a steel wire or a strain-resistance carrier thread, made, for example, of aramide or polyamide.

In one alternative suitable development, the functional element is embodied as a latent heat accumulator. In this embodiment, the data cable can absorb temperature peaks particularly well during operation by storing heat in the functional element. The functional element is then regenerated at a later time and in the process the heat is output again. The latent heat accumulator therefore acts as a thermal buffer and is fabricated, for example, from polymer-based material. A suitable latent heat accumulator is described, for example, in German patent DE 10 2012 014 944 and is used there as a thermal energy accumulator in a cable.

The different variants of the functional element can, of course, also be combined with one another. Other variants are also conceivable. For example, an optical fiber is alternatively or additionally used as a functional element. An internal wire which is insulated with respect to the external wires is also basically suitable as a functional element.

As already mentioned, the pre-formed individual wires each have a cross-sectional shape such that the cross section of the entire assembly is as round as possible and therefore is as close as possible to a circle. In this context, in the simplest case, a cross-sectional shape which is at least approximated to a triangular cross-sectional shape is selected for the external wires, wherein the shape of an equilateral triangle is preferred. In the assembly, the external wires are then arranged in such a way that when viewed in cross section a corner of each external wire points radially inward in the direction of the center. When an internal wire or a functional element is used, the external wires then lie as it were in a punctiform fashion against the internal wire or on the functional element; when an intermediate layer is used between the external wires and the center this is correspondingly the case on the intermediate layer. Therefore, there is generally essentially punctiform support between the external wires and the center, owing to which there is a high degree of flexibility and a high level of alternating bending resistance of the assembly, and ultimately also of the stranded conductor and of the data cable overall. In contrast to this, in the case of compacted stranded conductors, contact zones are formed which are linear in shape when considered in cross section, i.e. transversely with respect to the longitudinal direction. In particular, in this context the individual wires are embodied approximately in the manner of a trapezium, wherein, in particular, the trapezium surface which is oriented toward the internal wire is concavely arched and fits snugly against the grounding of the internal wire.

A triangular cross-sectional shape in which the corners are rounded, i.e. the cross-sectional shape has rounded corners, is expediently selected for the external wires. Such a cross-sectional shape can, inter alia, be implemented more easily.

In one advantageous development, the sides of the triangular cross-section are arched outward and therefore configured in an arcuate shape, i.e. the cross-sectional shape of the external wires has rounded corners. In this way, the external wires touch one another, as it were, in a punctiform fashion, which in turn entails a high degree of flexibility and a high level of alternating bending resistance of the assembly. Nevertheless, the arcuate shape is characterized, in particular, by a radius which is larger than the radius of a customary circular single wire, with the result that the actual contact area of two adjacent external wires is larger than in the case of a conventional stranded conductor.

Furthermore, one embodiment of the stranded conductor is preferred in which the external wires have a cross-sectional shape in the manner of a Reuleaux triangle with rounded corners. A cross-sectional shape which is configured in such a way is distinguished by convexly outwardly arched side faces and rounded corners. Therefore, both on the side faces and on the corners the individual wires bear only in a punctiform fashion on adjacent stranded conductors when considered in cross section. This configuration is particularly advantageous in respect of the desired high level of alternating bending capability.

In contrast, a round cross section is preferred for the internal wire or the functional element.

According to a further advantageous refinement of the stranded conductor, the external wires are shaped and arranged in such a way that in a good approximation a punctiform support is provided between adjacent external wires, i.e. in each case two adjacent external wires touch one another in a punctiform fashion. Punctiform is understood to mean here, in particular, that the external wires which bear one on the other are basically curved at the contact point, i.e. are embodied in a convex fashion and as a result touch one another only at a point when considered in cross section. Consequently, the external wires together form an external layer which encapsulates and encloses the center, which layer, when viewed in cross section, has an essentially circular circumference.

Alternatively, two adjacent external wires touch one another over a surface, i.e. linearly when viewed in cross section. In this context, the contact face between the external wires is advantageously increased in size, with the result that reduced losses occur during the transmission of signals. The contact over a surface occurs, in particular, after the stranding as a result of the fact that in this context the external wires are at least slightly pressed one against the other. A contact zone which is linear in cross section, in particular straight, is then formed between two adjacent external wires, i.e. a corresponding contact face is produced in the longitudinal direction of the stranded conductor. Owing to the generally curved external contour, the external wires do not bear completely one against the other over a surface but rather only in respective partial sections of the circumferential contours of the external wires. As a result, an optimum compromise is implemented between good alternating bending resistance and a large, i.e. low-loss, contact zone. In cross section, the contact zone is then limited, in particular, by the interstices, to be precise in particular both from the inside and from the outside.

The external wires are preferably covered with an insulating sheath or insulation, for example made of plastic, wherein the wall thickness of the insulation is virtually constant owing to the virtually circular circumference of the outer layer when viewed in the circumferential direction. As a result, a very thin wall thickness can advantageously be implemented, with the result that a correspondingly configured stranded conductor has relatively low weight and a relatively low requirement for space. Corresponding stranded conductors are provided in this context, in particular, for the field of motor vehicles and correspondingly preferably configured for this purpose of use.

The assembly composed of individual wires advantageously has a cross-sectional area of less than 2.5 $mm^2$ and, in particular, less than 1.5 $mm^2$. The cross-sectional area is, in particular, the sum of the cross-sectional shapes of the external wires, i.e. the center is removed. When an internal wire is additionally used, it is correspondingly added to the calculation. Cross sectional areas of 0.35 $mm^2$, 0.75 $mm^2$ and 1 $mm^2$ are particularly widespread and are also preferably used.

The stranded conductor expediently has a lay length which is preferably 4 mm to 30 mm. In this context, relatively low lay lengths are advantageous at relatively high frequencies. Lay length is understood to be the axial length of the stranded conductor which is required for a 360° winding of a respective individual wire. In contrast to conventional strands with rounded individual wires, the lay length is significantly shorter, in particular approximately by a factor of 2. In particular, the lay length is also at least largely independent of the respective diameter of the assembly composed of individual wires. Stranded conductors of different diameters can therefore have identical or at least comparable lay lengths which are in the specified range. In the case of conventional assemblies, the lay length varies with the diameters. Investigations have revealed that this shortened lay length is particularly advantageous and an undesired rotation of the non-round individual wires about their center axis out of the desired rotational orientation is avoided. This ensures a defined desired orientation of the individual wires in the assembly.

On the basis of the basic concept presented here, that is to say the use of preformed individual wires with a non-round cross section, it is, furthermore, also possible to implement stranded conductors which have a plurality of layers of external wires, wherein the individual layers are preferably arranged concentrically with respect to the center. With these stranded conductors as well, this concept permits better utilization of the space to be achieved.

Irrespective of the number of layers composed of external wires, within the scope of the manufacture of corresponding stranded conductors firstly pre-fabrication of the individual wires with a non-round cross section takes place, in particular by means of a customary multi-stage drawing process. Subsequently, the individual wires which are shaped in this way are preferably subjected to an annealing procedure (soft annealing) in order to ensure the desired bending-elastic properties of the individual wires. The individual wires are then subsequently stranded or twisted and finally provided with the insulation, wherein, for example, an extruder or stranding machine is positioned directly downstream for this purpose. Pressing of the individual wires or the assembly composed of individual wires and a further annealing procedure after the stranding are not performed.

Other features which are considered as characteristic for the invention are set forth in the appended claims.

Although the invention is illustrated and described herein as embodied in a data cable and a stranded conductor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
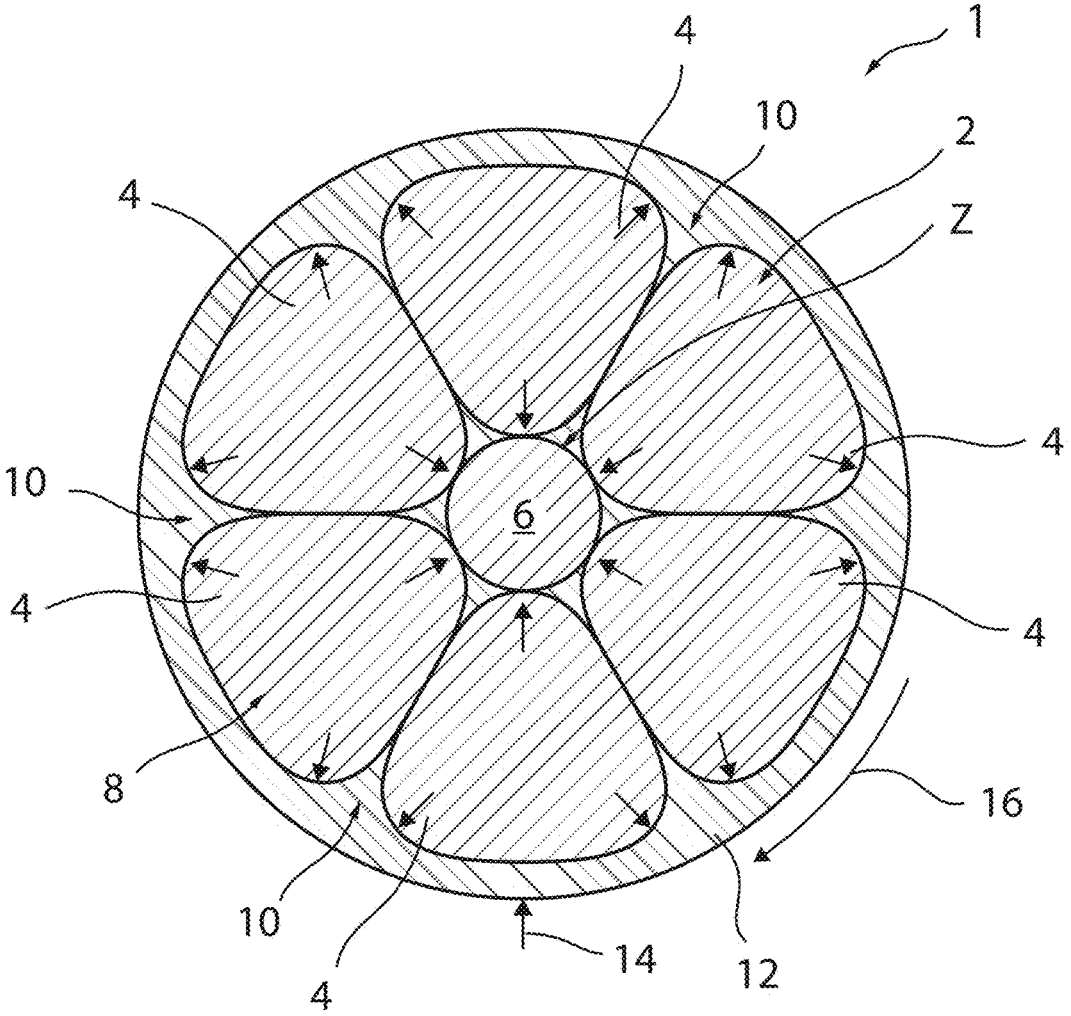
FIG. 1 is a diagrammatic, sectional view of a stranded conductor with an internal wire and with a plurality of external wires according to the invention.

Referring now to the figures of the drawings in detail and first, particularly to FIG. 1 thereof, there is shown a data conductor 1 which is described by way of example below has a stranded conductor 2 which is constructed from seven individual wires in the exemplary embodiment, wherein six individual wires are arranged as external wires 4 around a center Z in which a central conductor, here an internal wire 6, is arranged. The internal wire 6 has here a circular cross section, and the external wires 4 are positioned evenly distributed around this internal wire 6. In one preferred non-illustrated variant, the internal wire 6 is dispensed with, i.e. the center Z is then free of an internal wire.

The external wires 4 are identical, i.e. configured identically and have a cross-sectional shape which corresponds in a good approximation to the shape of a Reuleaux triangle with rounded corners. This cross-sectional shape is illustrated in an enlarged form in FIG. 2, and is depicted together with an equilateral triangle with a side length L for purposes of comparison. In this way it is apparent that the cross-sectional shape of the external wires 4 has rounded corners based on a triangular shape. In addition, the sides are arched outward. In other words, the cross-sectional shape of the external wires 4 is constructed from two different circular-segment shapes, wherein the corners of the Reuleaux triangular shape are each formed by a circular segment shape with a radius RE, and wherein the sides of the Reuleaux triangular shape are each formed by a circular segment shape with a radius RS.

In the case of a stranded conductor 2 for ultrathin vehicle lines, the side length L is, for example, in the range from 0.25 mm-0.6 mm, in particular is approximately 0.4 mm. The radius RS is approximately ten times the radius RE and is, for example, 0.6 mm to 1 mm, in particular is 0.8 mm.

The assembly composed of external wires 4 and the internal wire 6 is configured in such a way that when considered in cross section one corner of each external wire 4 bears in a punctiform fashion on the internal wire 6, and in that a punctiform support, that is to say punctiform contact, is also provided between adjacent external wires 4.

The external wires 4 together form a closed outer layer 8 by which the center Z is completely enclosed. The outer layer 8 also has when viewed in cross section a circumferential contour which is circular in a good approximation, but a remaining interstice 10 is formed in each case in the intermediate region between two external wires 4 on the circumferential side. These interstices 10 are, however, relatively small compared to a stranded conductor according to the prior art in which external wires with a circular cross section are arranged around an internal wire which also has a circular cross section.

The data conductor 1 also has insulation 12 which surrounds the outer layer and which is usually applied by extrusion to the stranded conductor 2. By virtue of the selected cross-sectional shape of the external wires 4 and the resulting relatively small size of the interstices 10, the wall thickness 14 of the insulation 12 is, in a good approximation, constant when considered in the circumferential direction 16 and can, in particular, be made very thin.

Figure 2:
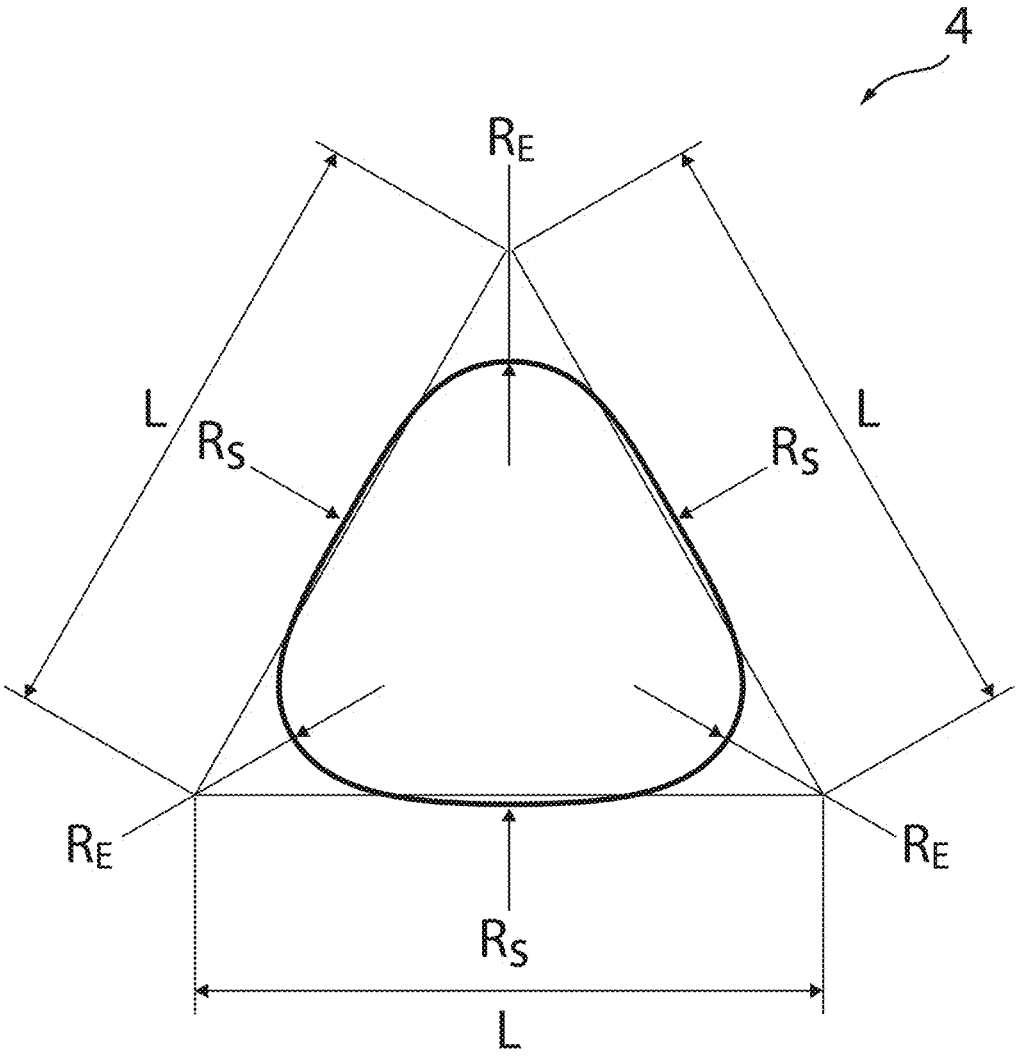
FIG. 2 is an enlarged cross-sectional illustration of one of the external wires.
Figure 3:
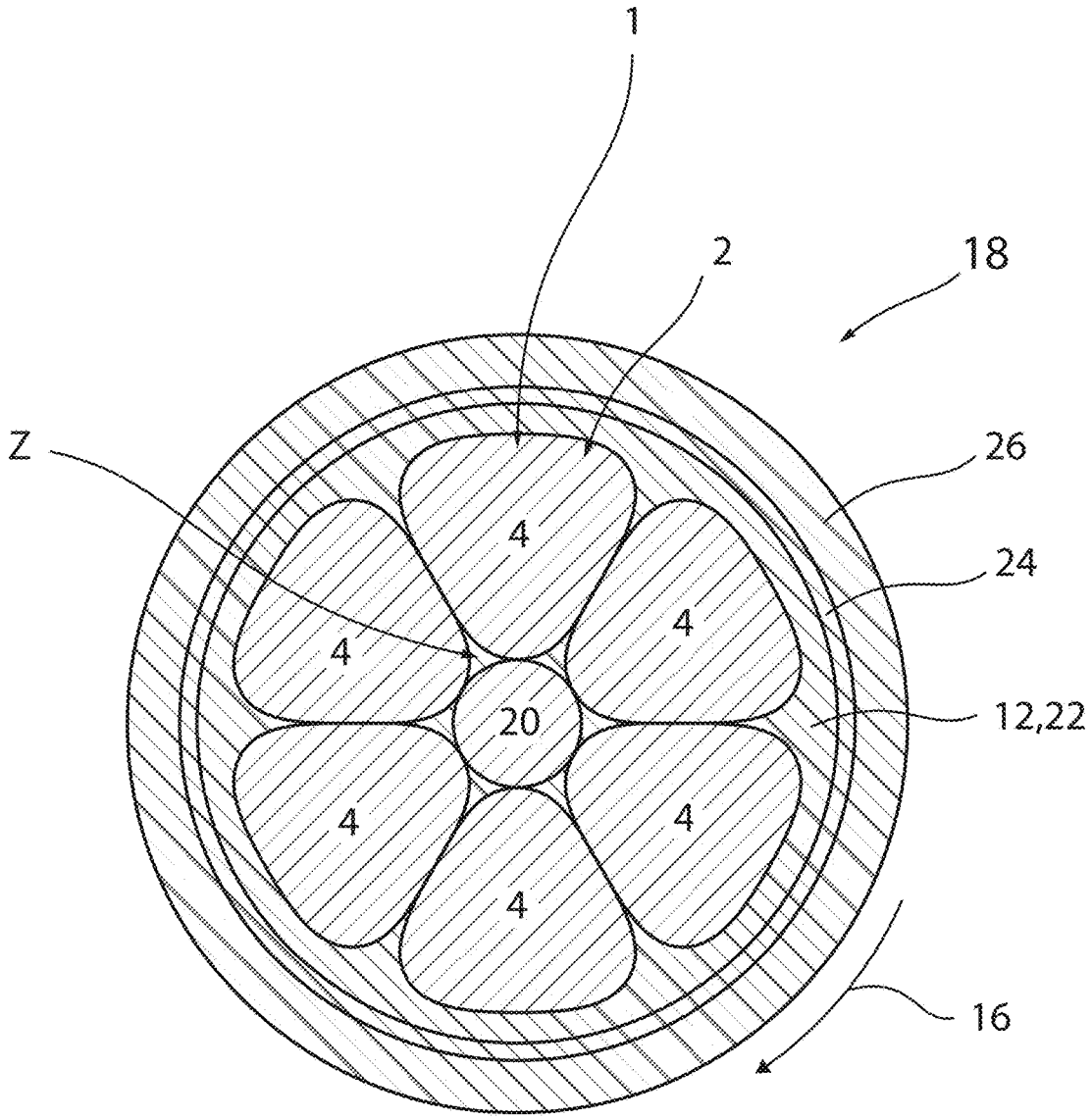
FIG. 3 is a sectional view of a data cable.
Figure 4:
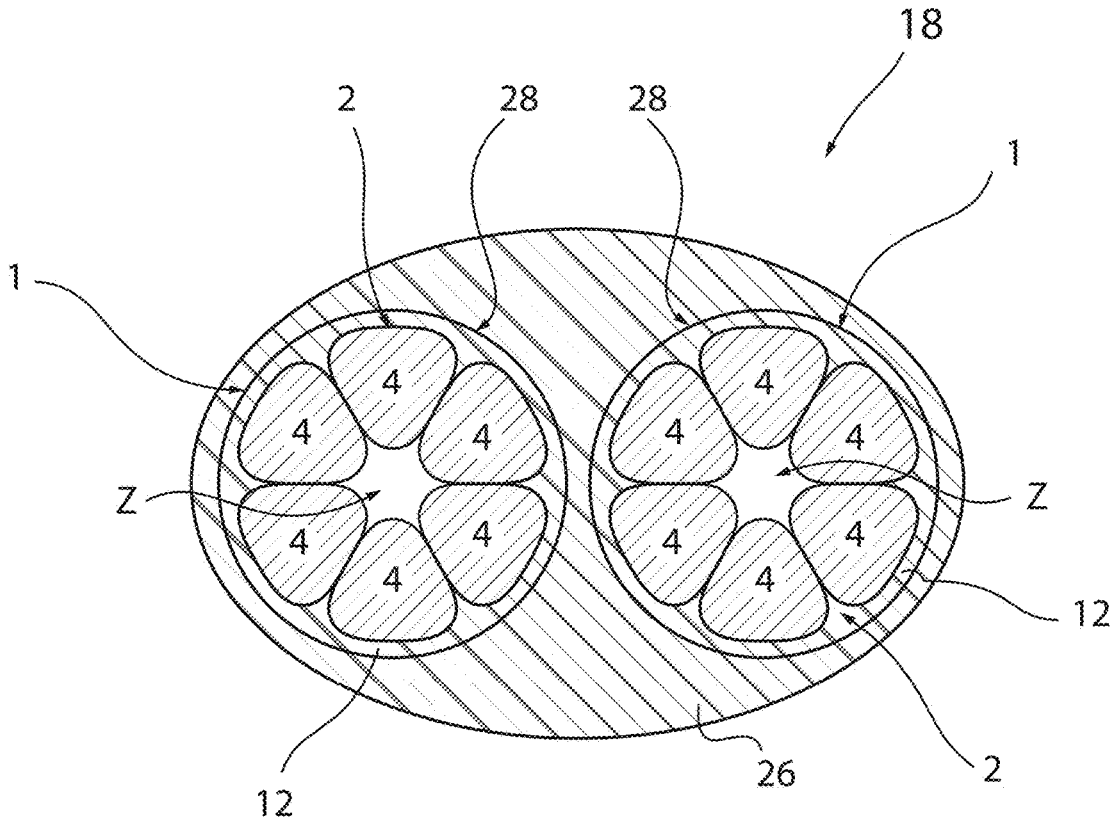
FIG. 4 is a sectional view of a variant of the data cable.

In addition, it becomes clear from FIGS. 1 and 2 that the stranded conductor 2 has overall a particularly round circumferential contour. As a result, the stranded conductor 2 is particularly well suited for use in a data cable 18. Variants of such a data cable 18 are illustrated in FIGS. 3 and 4. In this context, the specific shape and arrangement of the external wires 4 result in particularly homogenous distributions of current and voltage which are conducted by means of the stranded conductor 2. The risk of partial discharges is significantly reduced and likewise the resistance of the current, resulting in overall relatively low losses.

The data cable 18 shown in FIG. 3 is embodied as a coaxial cable and has a stranded conductor 2, with a plurality of external wires 4 as in FIG. 1. However, there is no internal wire 6 arranged in the center Z but instead a functional element 20. The latter is embodied, for example, as a strain relief element and then as an aramide fiber or a steel cable. Alternatively, the functional element 20 is a latent heat accumulator. For this purpose, for example a thermal polymer-based buffer is used.

The stranded conductor 2 is in turn surrounded by the insulation 12 which is at the same time a dielectric 22 of the data cable 18 here. The stranded conductor 2 and the dielectric form the data conductor 1. A shield 24, e.g. a shielding film, a braid or a tape is arranged around the dielectric 22. The shield 24 is in turn surrounded by an external sheath 26. As a result of the particularly round circumferential contour of the stranded conductor 2, the distance between the external wires 4 and the shield 24 is particularly homogenous in the circumferential direction, that is to say it has a particularly low variance, as a result of which the transmission properties of the data cable 18 are significantly improved.

FIG. 4 shows a further data cable 18 which is embodied here with two wires, i.e. with two stranded conductors 2. In the case of these stranded conductors 2, both an internal wire 6 and a functional element 20 are dispensed with, with the result that an empty space is present in the center Z. The external wires 4 are each surrounded by insulation 12, with the result that overall two wires 28 are formed. These are combined in a common external sheath 26. In one non-illustrated variant, the two wires 28 are each additionally shielded or alternatively or additionally both wires 26 are surrounded by a common shield, in order to form a shielded wire pair. In addition, the two wires 28 are either twisted with one another to form a "twisted pair" or led parallel to one another as an "untwisted pair".

The omission of the internal wire in the center Z has the advantage particularly during preparation that a crimp which is attached to a respective wire 28 divides the stranded conductor 2 symmetrically, i.e. the even number of external wires 4 is distributed uniformly onto the two partial chambers of the crimp during the squeezing process. As a result, a particularly uniform mechanical load is produced. At the same time, the data cable 18 is overall lighter in weight and requires less material for fabrication.

The invention claimed is:

1. A data cable, comprising:

a data conductor having a stranded conductor surrounded by insulation, said stranded conductor having an unpressed assembly composed of a plurality of electrically contacted individual wires which are of a same type and being embodied as external wires and being disposed around a center, said external wires each being embodied with a non-round cross section, with a result that when viewed in cross section an extent of said external wires increases radially outward from the center, said stranded conductor being free of a central conductor.

2. The data cable according to claim 1, further comprising a shield surrounding said data conductor.

3. The data cable according to claim 2, wherein said data cable is a coaxial cable in which said stranded conductor and said shield are disposed concentrically.

4. The data cable according to claim 1, wherein said data conductor is one of two data conductors forming a wire pair.

5. The data cable according to claim 1, wherein said stranded conductor has an empty center.

6. The data cable according to claim 1, further comprising a functional element disposed in the center of said stranded conductor.

7. The data cable according to claim 6, wherein said functional element is a strain relief element.

8. The data cable according to claim 6, wherein said functional element is a latent heat accumulator.

9. The data cable according claim 1, wherein said external wires each have a triangular cross-sectional shape.

10. The data cable according to claim 1, wherein said external wires have a cross-sectional shape with rounded corners.

11. The data cable according to claim 1, wherein said external wires have a cross-sectional shape with outwardly bent sides.

12. The data cable according to claim 1, wherein in each case two adjacent ones of said external wires touch one another in a punctiform fashion.

13. The data cable according to claim 1, wherein in each case two adjacent ones of said external wires touch one another over a surface.

14. A stranded conductor comprising:

an unpressed assembly composed of a plurality of individual wires which are of a same type and are embodied as external wires and are disposed around a center which is free of a central conductor and having a central void surrounded by said individual wires, said external wires are each embodied with a non-round cross section, with a result that when viewed in cross section an extent of each of said external wires increases radially toward an outside from the center.

* * * * *